US005505356A

United States Patent [19]

Noriega et al.

[11] Patent Number: 5,505,356

[45] Date of Patent: Apr. 9, 1996

[54] DETACHABLE ARTICLE HOLDERS

[76] Inventors: Joseph R. Noriega, 901 W. Whittier Blvd., Montebello, Calif. 90640; Yukio Iwamasa, 5203 Deeboyar Ave., Lakewood, Calif. 90712

[21] Appl. No.: 118,529

[22] Filed: Sep. 9, 1993

[51] Int. Cl.[6] ..... A45F 5/00

[52] U.S. Cl. ..... 224/250; 224/240; 224/208; 224/215; 224/901; 224/904; 224/224; 2/338

[58] Field of Search ..... 224/219, 220, 224/221, 222, 223, 224, 228, 235, 236, 250, 253, 255, 267, 901, 904, 36, 239, 240, 151; 150/106, 107; 383/11, 14, 18; 2/311, 312, 338; 24/304, 306; D3/226

[56] References Cited

U.S. PATENT DOCUMENTS

| | | | |
|---|---|---|---|
| D. 272,867 | 3/1984 | Gwaltney et al. | D3/226 |
| D. 291,389 | 8/1987 | Crymes | 224/236 |
| D. 343,604 | 1/1994 | Rekow | 224/36 |
| 539,517 | 5/1895 | Hunt | 224/35 |
| 702,121 | 6/1902 | Wilcox | 2/312 |
| 756,177 | 3/1904 | Mills . | |
| 1,292,728 | 1/1919 | Dozier | 224/904 |
| 1,320,934 | 11/1919 | Schopp | 224/253 |
| 1,382,446 | 6/1921 | Warren | 224/222 |
| 1,394,720 | 10/1921 | Feltman | 2/311 |
| 1,418,371 | 6/1922 | Foster . | |
| 1,558,228 | 10/1925 | Botkin . | |
| 1,648,565 | 11/1927 | Primley | 224/240 |
| 2,351,158 | 6/1944 | Stelzer . | |
| 2,670,474 | 3/1954 | Schultz | 2/312 |
| 3,227,337 | 1/1966 | Santo, Jr. . | |
| 3,638,284 | 2/1972 | Baker | 24/306 |
| 4,029,242 | 6/1977 | Stoesser . | |
| 4,047,651 | 9/1977 | McMullen | 2/338 |
| 4,220,302 | 9/1980 | Hampton et al. | 224/205 |
| 4,332,338 | 6/1982 | Christiansen | 224/222 |
| 4,341,331 | 7/1982 | McDougall | 224/222 |
| 4,408,706 | 10/1983 | Hurley | 224/904 |
| 4,420,104 | 12/1983 | DiIenno | 224/250 |
| 4,440,525 | 4/1984 | Perla . | |
| 4,569,417 | 2/1986 | Lee et al. | 2/338 |
| 4,579,265 | 4/1986 | Schiller . | |
| 4,712,766 | 12/1987 | Ehrenhalt | 224/901 |
| 4,718,585 | 1/1988 | Atkins, Sr. . | |
| 4,796,790 | 1/1989 | Hamilton | 224/228 |
| 4,819,846 | 4/1989 | Hannemann | 224/901 |
| 4,856,149 | 8/1989 | Brame | 224/220 |
| 4,966,320 | 10/1990 | DeSantis et al. . | |
| 4,991,234 | 2/1991 | Greenberg | 2/311 |
| 4,993,614 | 2/1991 | Bonofiglo | 224/224 |
| 5,020,711 | 6/1991 | Kelly | 224/901 |
| 5,045,979 | 9/1991 | Stevens | 224/224 |
| 5,233,942 | 8/1993 | Cooper et al. | 224/240 |
| 5,263,618 | 11/1993 | Talavera | 224/901 |
| 5,345,633 | 9/1994 | Harnish | 224/151 |

FOREIGN PATENT DOCUMENTS

| | | | |
|---|---|---|---|
| 1587125 | 4/1981 | United Kingdom | 224/901 |

OTHER PUBLICATIONS

J.A.M.A.; Oct. 18, 1958 vol. 168, No. 7.

*Primary Examiner*—Henry J. Recla
*Assistant Examiner*—Gregory M. Vidovich
*Attorney, Agent, or Firm*—David Weiss

[57] ABSTRACT

Article retaining devices for advantageous utilization in detachable combination with a lumbar support belt. In one embodiment, a pouch includes straps secured thereto and extending about the inner side of the lumbar support belt and cooperating near their free ends with cooperating fastening means on the pouch's front side for releasably fastening the strap ends thereto. Separate implement holders may be removably secured to the lumbar support belt as well as to the pouch.

14 Claims, 4 Drawing Sheets

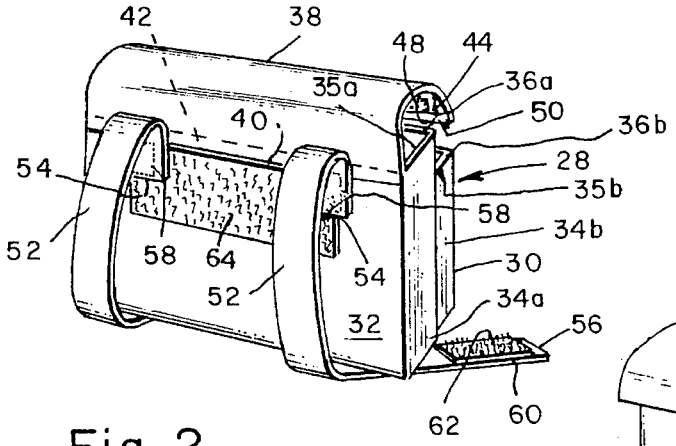
Fig. 2.
Fig. 3.
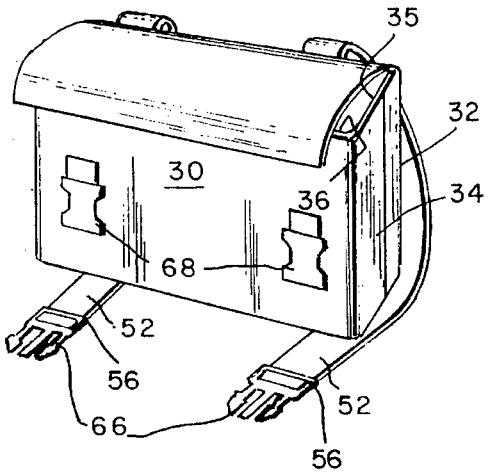
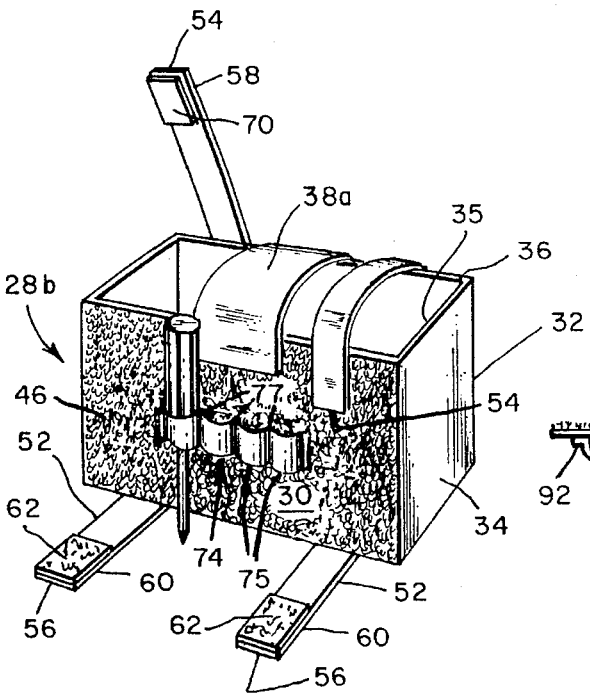
Fig. 4.
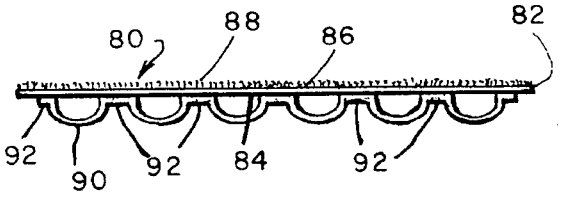
Fig. 5.

Fig. 6.
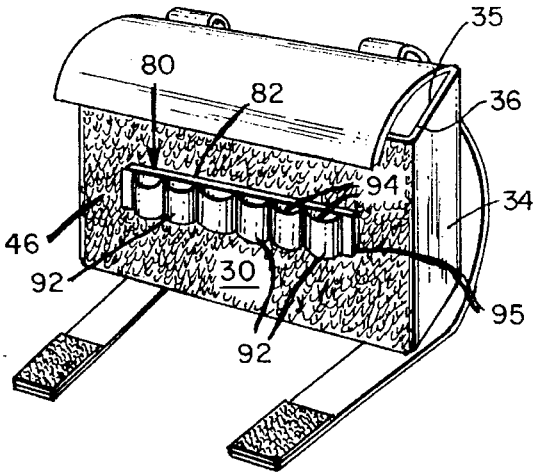
Fig. 7.
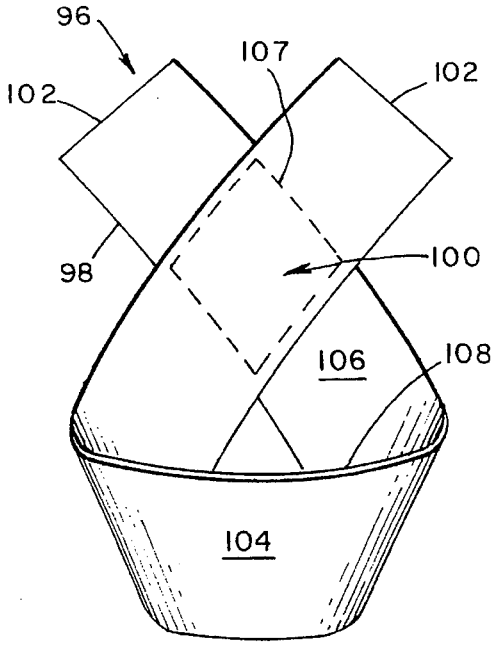
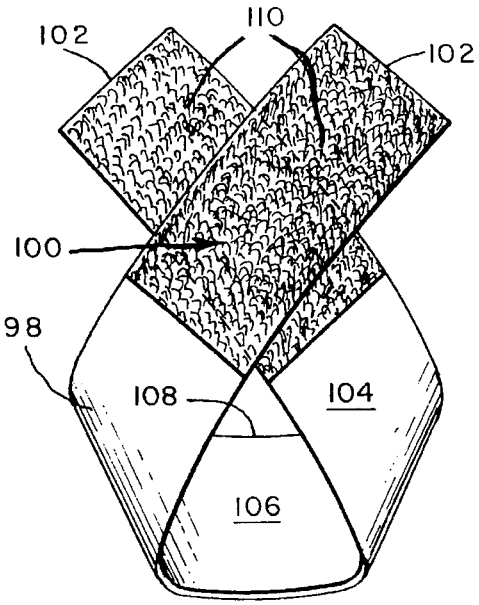
Fig. 8.
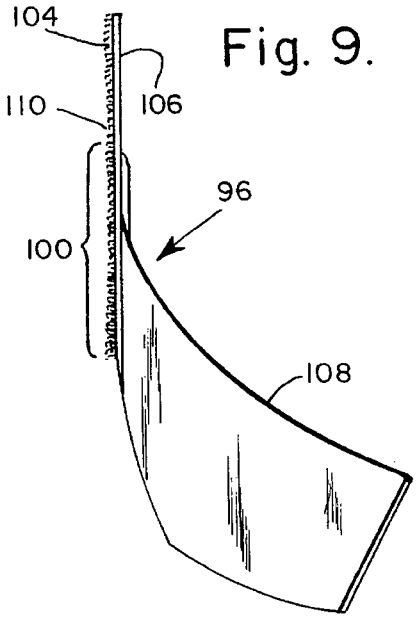
Fig. 9.

DETACHABLE ARTICLE HOLDERS

BACKGROUND OF THE INVENTION

This invention relates to apparatus for holding articles, and more particularly to detachable article holders for use in combination with lumbar support belts.

Lumbar support belts (also commonly known as back-belts or lifting belts) are well known devices which are worn about a person's lumbar region for promoting comfort and for decreasing the likelihood of certain types of back injury. Such belts are popularly worn by persons while at rest as well as while engaging in physical activities, whether at work or at play.

Such activities often require the use of articles such as small implements and supplies of various types, for example hand-held mechanical tools, electronic devices, flashlights and supplies for sports, hobby and work activities. Different activities, of course, require different articles, or different sets of articles, which the active person usually carries in containers such as a hand-carried tool box, or on a separate tool belt designed to be worn about the waist, or in a basket or pouch depending from a shoulder strap.

SUMMARY OF THE INVENTION

The present invention provides devices for containing or retaining articles such as implements and supplies, which devices are advantageously utilized in detachable combination with a lumbar support belt, although they may be employed in combination with most other types of belts. The article holders of the present invention provide a needed utilitarian function, as well as convenience, for persons who wear lumbar support belts in their work and/or play activities.

Briefly described, the apparatus of the present invention comprises, in combination, a lumbar support belt having an inner side and an outer side when worn by a person; an article holder having a rear side for engaging the outer side of the lumbar support belt; and securing means on the article holder for cooperating with the lumbar support belt for removably securing the holder to the belt with the rear side of the holder disposed toward the outer side of the belt.

One embodiment of the article holder comprises a pouch having a front side and a rear side, the front side including fastening means thereon and the rear side disposed toward the outer side of the belt. At least one and preferably two straps are provided, each strap having a first end secured to one side (preferably the rear side) of the pouch and a free second end, the straps extending about the inner side of the lumbar support belt and cooperating near their second ends with the fastening means on the front side of the pouch for releasably fastening the strap ends to the front side of the pouch. Preferably, the fastening means on the front side of the pouch includes cooperative loop-pile fastening means, and the straps include thereon near their second ends cooperative hook-pile fastening means. Such cooperative loop-pile and hook-pile fasteners are preferably of the type sold under the trademark VELCRO®.

The straps are of sufficient length for extending over the belt and about the inner side of the belt and under the belt and under the pouch with the straps cooperating near their second ends with the fastening means on the front side of the pouch for removably securing the pouch to the belt. Additional cooperative fastening means may be provided on the outer side of the belt and the rear side of the pouch for preventing movement or slippage of the pouch with respect to the belt when the pouch is secured to the belt by means of the straps.

Another embodiment of an article holding device provided by the present invention includes a detachable implement holder comprising a flexible panel including a front side and a rear side, the front side including thereon means for retaining implements and the rear side including thereon cooperative fastening means cooperating with cooperative fastening means on the outer side of the lumbar support belt for removably securing the holder to the belt. The cooperative fastening means on the outer side of the belt includes loop-pile fastening means and the rear side of the holder flexible panel includes hook-pile fastening means. This implement holder may be removably secured to the front side of the pouch, if desired, with the cooperative hook-pile fastening means on the rear side of the holder flexible panel cooperating with loop-pile fastening means on the front side of the pouch.

A third embodiment of the article holding apparatus according to the present invention includes a detachable implement holder comprising a loop of flexible strip material joined at a joint near the ends of the strip with one surface of the strip facing the other surface of the strip at the joint, and cooperative fastening means on the strip cooperating with cooperative fastening means on the outer side of the belt for removably securing the looped strip at the joint to the belt. The cooperative fastening means on the outer side of the lumbar support belt preferably includes loop-pile fastening means, and the strip includes cooperative hook-pile fastening means on the surface of the strip outwardly of the loop at the joint cooperating with the cooperative loop-pile fastening means on the outer side of the belt for removably securing the looped strip to the belt. Means are preferably provided which secure the strip to itself at the joint, and the joint includes a rear side including the hook-pile fastening means which preferably extends from the joint outwardly of the loop. This implement holder may be removably secured to the front side of the pouch, if desired, with the cooperative hook-pile fastening means on the rear side of the joint cooperating with loop-pile fastening means on the front side of the pouch.

In accordance with another aspect of the detachable loop implement holder of the invention, there is provided in combination: a flexible strip for forming a loop depending from a joint with one surface of the strip engaging the other surface of the strip at the joint; first cooperative fastening means on the one surface of the strip and extending toward one end of the strip; second cooperative fastening means on the other surface of the strip for cooperating with the first cooperative fastening means for securing the strip to itself at the joint to form the loop; and third cooperative fastening means on the one surface of the strip and extending toward the other end of the strip for cooperating with cooperative fastening means on a surface, such as a generally vertical surface, for removably securing the looped strip thereto. The first and third cooperative fastening means preferably include hook-pile fastening means, and the second cooperative fastening means preferably includes loop-pile fastening means extending toward the other end of the strip, with the first and second cooperative fastening means adjustably securable along the strip for adjusting the size of the loop.

BRIEF DESCRIPTION OF THE DRAWING

The novel features which are believed to be characteristic of the invention, together with further advantages thereof, will be better understood from the following description considered in connection with tile accompanying drawings in which preferred embodiments of the invention are illustrated by way of example. It is to be expressly understood, however, that the drawings are for the purpose of illustration and description only and are not intended as a definition of the limits of the invention.

FIG. 2 is a perspective generally rear elevation view of a preferred embodiment of a pouch according to the present invention;

FIGS. 3 and 4 are perspective generally front elevation views of two alternative embodiments of a pouch according to the present invention;

FIG. 5 is a plan view of a preferred embodiment of a detachable implement holder according to the present invention;

FIG. 6 is a perspective generally front elevation view of another alternative embodiment of a pouch according to the present invention, with the detachable implement holder of FIG. 5 shown in perspective generally front elevation view and secured thereto;

FIG. 7 is a perspective front elevation view of a second preferred embodiment of a detachable implement holder according to the present invention;

FIG. 8 is a perspective rear elevation view of the detachable implement older of FIG. 7;

FIG. 9 is a side elevation view of the detachable implement holder of FIG. 7;

FIG. 10*a* is an elevation view of one side or surface of an alternative embodiment of a detachable implement holder of the loop-type shown in FIGS. 7–9, and FIG. 10*b* is an elevation view of the reverse or other side or surface on the implement holder of FIG. 10*a.

DESCRIPTION OF THE PREFERRED EMBODIMENTS

Figure 1:
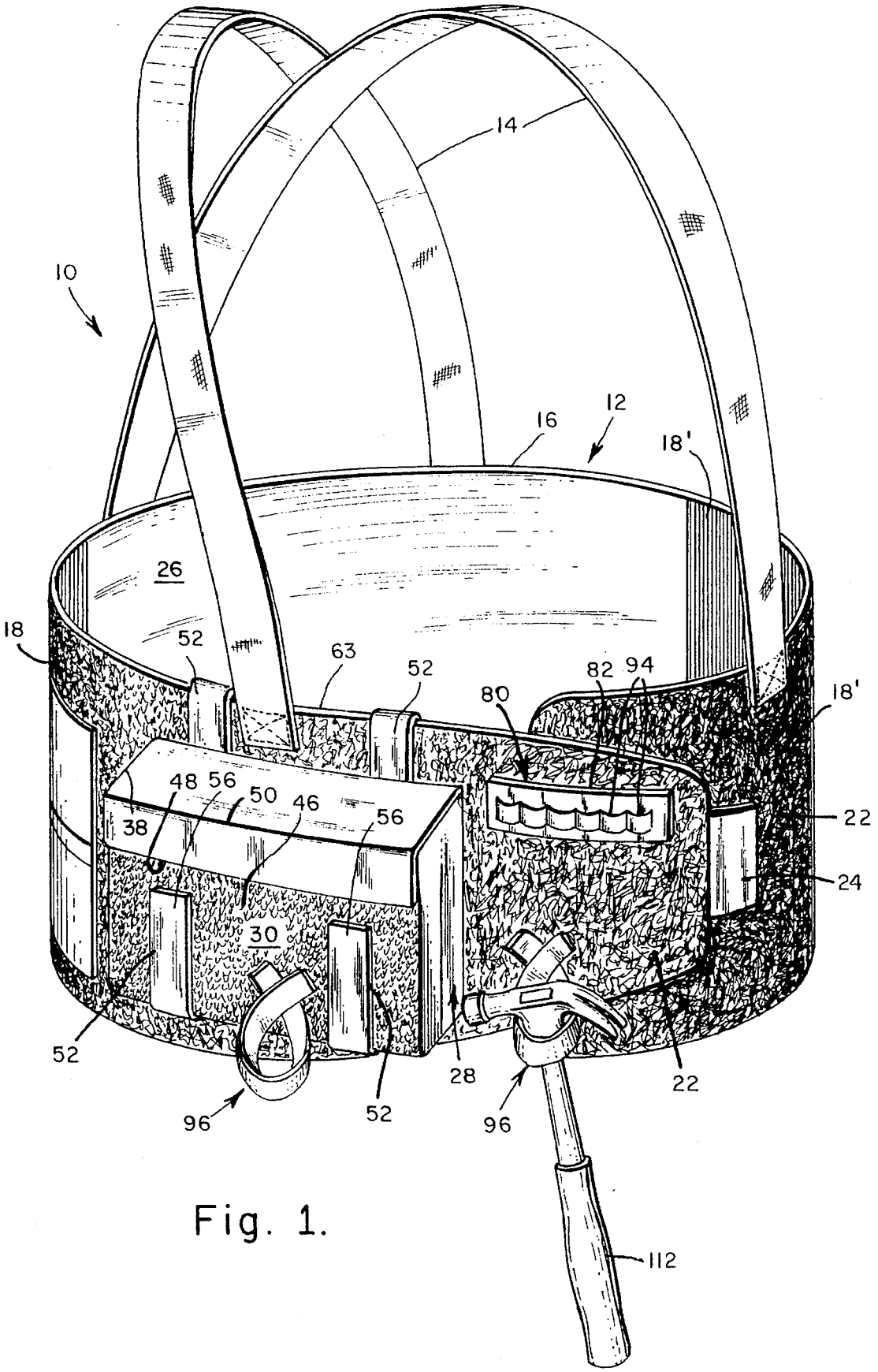
FIG. 1 is a perspective generally front elevation view of article holding apparatus according to the present invention, including a typical lumbar support belt and preferred embodiments of article holders in combination therewith.

Turning first to FIG. 1, there is shown a typical lumbar support belt assembly 10, including a lumbar support belt 12 to be worn about a person's lumbar region and a pair of suspenders 14 secured to the belt 12 and worn from the person's shoulders. The lumbar support belt 12 includes a laterally elastic fabric section 16 and two substantially non-elastic fabric end sections 18, 18' laterally of the elastic section 16. The outer surface or side 20 of each of the fabric end sections 18, 18' contains or has secured thereon a loop-pile material which may be utilized as a cooperative loop-pile fastening material, indicated generally by the reference numeral 22.

When the suspenders 14 are worn from the person's shoulders with the belt's end sections 18, 18' situated generally in front of the person, the belt 12 may be closed about the person's lumbar region while stretching the elastic section 16 for pressing against the person's back. This is accomplished by overlapping portions of the end sections 18, 18' and securing the overlapping end section 18 to the other end section 18' by releasably fastening a closure tab 24 (secured to the end section 18) containing hook-pile fastening material on its underside (i.e., facing the outer side 20 of the overlapped end section 18') cooperating with the loop-pile fastening material 22 on the overlapped end section 18'. Such loop-pile material and hook-pile material complement or cooperate with one another for providing a releasable fastener, as is well known and such as marketed under the trademark VELCRO®. As used herein, the terms "loop-pile" and "hook-pile" refer to such cooperative complementary or cooperative fastening materials such as marketed under the trademark VELCRO®.

When worn by a person, as just described, the belt 12 may be considered as having an inner surface or side 26 (i.e., a surface disposed toward or facing the wearer's body) and the outer surface or side 20 (i.e., a surface disposed or facing away from the wearer's body).

One aspect of the invention includes a pouch 28 removably secured to the lumbar support belt 12. The pouch 28 includes a front side 30, facing away from the wearer's body when secured to the worn belt 12. As shown in FIG. 2 the pouch 28 includes a rear side 32, which is caused to engage the outer side 20 of the belt 12 when the pouch 28 s secured to the belt 12, as may be appreciated when viewing FIG. 1.

The pouch 28 may be a multiple pouch as shown in FIGS. 1 and 2, i.e. the pouch 28 may include two or more compartments 34, for example a first compartment or pocket 34*a* having an opening 35*a* which may be along its top edge 36*a*, and a second compartment or pocket 34*b* secured to the front of the first compartment 34*a* and having an opening 35*b* which may be along its top edge 36*b* forwardly of and preferably just below the opening 35*a* of the first compartment 34*a*. Alternative embodiments of the pouch 28 may comprise a single pouch, such as is shown in FIGS. 3, 4 and 6, i.e. having a top-loading compartment or pocket 34 with an opening 35 along its top 36. In either case, the pouch 28 is considered as having a front side 30 and a rear side 32 as previously described.

The pouch 28 preferably includes a closure panel or strip 38 having a first longitudinal edge 40 secured substantially along the top 42 (shown in phantom) of the pouch's rear side 32. The closure strip 38 extends over the top 36 of the pouch 28, for engaging the pouch's front side 30, for closing one or both of the openings 35. The underside 44 of the closure strip 38 (i.e. the surface 44 of the strip 38 facing the pouch's front side 30 when engaged by the strip 38) includes hook-pile fastening material thereon for cooperating with loop-pile fastening material 46 on the pouch's front side 30. A margin or edging 48 of a non-fastenable material is secured along a second longitudinal edge 50 of the closure strip 38. When the closure strip 38 is caused to extend over the top 36 of the pouch 28, the closure strip's underside 44 including the hook-pile fastening material engages the loop-pile fastening material 46 on the pouch's front side 30, for releasably fastening the closure strip 38 in the vicinity of its second edge 50 to the pouch's front side 30. Since the edging or margin 48 is non-fastenable to the front side 30, it may be grasped and pulled upwardly and outwardly for releasing the closure strip 38 from the pouch's front side 30.

As best shown in FIG. 2, the preferred embodiment of the pouch 28 includes two flexible straps 52, which may be strips of webbing material, each strap 52 having a first end 54 and a second end 56. The first ends 54 of the straps 52 (or first end portions 58 at the first ends 54 of the respective straps 52) are secured to the rear side 32 of the pouch 28, such as by sewing, preferably near the top 42 of the pouch's rear side 32 and preferably laterally spaced symmetrically therealong. Alternatively, a laterally centrally positioned single strap 52 may be employed, or more than two straps 52 may be secured to the pouch's rear side 32 in spaced relation therealong.

The straps 52 include second end portions 60 at the straps' free second ends 56. Pads or strips of cooperative hook-pile fastening material 62 are respectively secured to each of the straps' second end portions 60, such that the hook-pile fastening material 62 faces and is in contact engagement with the cooperative loop-pile material 46 on the front side 30 of the pouch 28 when the straps 52 are brought under the pouch 28 for engaging the pouch's front side 30.

When securing the pouch 28 to the lumbar support belt 12 (see also FIG. 1), the pouch's rear side 32 is placed in engagement with the outer side of the belt 12 and preferably the belt's end section 18. The straps 52 are caused to extend over the top 63 of the belt 12, then downwardly about the belt's inner side 26, then under the belt 12, then under the pouch 28, and upwardly such that the straps' second end portions 60 engage the pouch's front side 30 with the hook-pile material 62 on the end-portions 60 cooperating with the loop-pile material 62 on the end-portions 60 cooperating with the loop-pile material 46 on the pouch's front side 30. The straps 52 are each of sufficient length for accomplishing these results.

When the lumbar support belt 12 is worn by a person, the belt's end section 18 is drawn against the person's body in reaction to the stretched elastic belt section 16 as previously described. The portions of the straps 52 extending about the belt's inner side 26 are accordingly captured between the person's body and the taut belt section 18, and are retained thereby. The pouch 28 is therefore secured to the belt 12 even if the straps 52 are longer than the minimum length necessary to ensure fastening cooperation between the straps' end portions 60 and the pouch's front side 30. In such case, the secured pouch 28 may be free to move slightly away from or slide with respect to the belt 12.

In order to prevent such movements, the rear side 32 of the pouch 28 preferably includes thereon a pad or strip of cooperative hook-pile fastening material 64, which may be secured thereto preferably along the vicinity of the top 42 of the pouch's rear side 32 as shown in FIG. 2. When the pouch 28 is secured to the belt 12, the hook-pile material 64 on the pouch's rear side 32 cooperates with the loop-pile material 22 on the outer side 20 of the belt end section 18. The resulting fastening between these loop-pile and hook-pile materials 22, 64 functions for preventing movement of the pouch 28 with respect to the belt end section 18. Such fastening also serves to assist the wearer in placing the pouch's rear side 32 in engagement with the belt's outer side 20 when securing the pouch 28 to the belt 12.

The straps' second end portions 60 may be released or detached from the pouch's front side 30 by pulling the straps 52 at their second ends 56 downwardly away from the pouch's front side 30, thereby permitting the pouch 28 to be detached or removed from the belt 12.

It is noted that, when the pouch 28 is secured to the belt 12 as shown in FIG. 1, the straps 52 are positioned such that the hook-pile fasteners 62 at the strap ends 60 are at an advantageous angle with respect to the cooperative loop-pile fastener material 46 on the pouch's front side 30. The weight of articles placed in the pouch, or pulling on the pouch when worn, presents forces between the cooperating loop-pile and hook-pile materials 46, 62 at angles which would appear to be favorable for promoting fastening strength.

In one suitable example of a pouch 28—which is securable to a lumbar support belt 12 having height dimensions of approximately 8 inches and 6 inches at places therealong where the straps 52 may be positioned—the height of the pouch 28 was approximately 7 inches and its width approximately 9 inches, and the straps 52 were each approximately 1¾ inches wide and 19½ inches long (including the end portions 56, 58), with the length of the hook-pile pad 62 being approximately 4 inches.

Other cooperative fastening means may be utilized for releasably fastening the free ends of the straps to the front side of the pouch. For example, the pouch **28*a* shown in FIG. 3 includes cooperative snap buckle fasteners of a type well known in the art. The straps 52 may have male snap buckle members 66 respectively secured to the strap ends 56, for mating with respective female snap buckle members 68 secured to the pouch's front side 30**.

Further, the first ends of the straps may be detachable from the pouch. For example, the pouch **28*b* of FIG. 4 includes straps 52 wherein the first end portions 58 at the first ends 54 include thereon a pad or strip of cooperative hook-pile material 70 for cooperating with the loop-pile material 46 on the front side 30 of the pouch 28*b*. Alternatively, the hook-pile 70 on the straps' first end portions 58 may cooperate with loop-pile material which may be situated on the inside surface 72 of the pouch's rear side 32. As represented in FIG. 4, however, the straps' first end portions 58 are releasably fastened to the pouch's front side 30, with the straps 52 extending over the pouch. When the pouch 28*b* is secured to the lumbar support belt 12, the straps 52 extend over the pouch's top opening 35 and the belt's top edge 63 (FIG. 1), downwardly about the belt's inner side 26, under the belt, under the pouch, and upwardly in front of the pouch 28*b* for releasably fastening the hook-pile 62 on the straps' second end portions 60 to the loop-pile 46 on the pouch's front side 30. In this alternative embodiment, the closure strip 38*a* is preferably of a dimension such that it may be contained between the two straps 52 when the straps' first end portions 58 are secured to the pouch's front side 30**.

As further shown in FIG. 4, the pouch **28*b* includes an implement holder 74 secured to the pouch's front side 30. The implement holder 74 comprises a strip of webbing material which is laterally secured, as by sewing, to the pouch's front side 30 along spaced vertical lines 75 to form a series of loops 76 for retaining implements such as the screwdriver 78** shown by way of example.

In FIG. 5 there is illustrated a detachable implement holder 80, which otherwise functions similarly to the implement holder 74 shown in FIG. 4. The detachable implement holder 80 of FIG. 5 comprises a flexible panel having a front side 84 and a rear side 86, with hook-pile 88 on the rear side 86. A strip of webbing material 90 is laterally secured to the panel's front side 84 along spaced vertical lines 92 (see also FIG. 6) to form a series of loops 94 for retaining implements such as the screwdriver 78 shown in FIG. 4.

As shown in FIG. 1, the detachable implement holder 80 may be removably secured to the lumbar support belt 12, by engaging the rear side 86 of the flexible panel 82 and the outer side 20 of the belt end section 18, causing the panel's hook-pile material 88 (FIG. 5) to cooperate with the belt's loop-pile material 22 (FIG. 1) for releasably fastening the panel 82 to the belt's outer side 20.

As shown in FIG. 6, the detachable implement holder 80 may be removably secured to the pouch's front side 30, by similarly engaging the cooperative hook-pile fastening material 88 of the rear side 86 of the panel 82 and the cooperative loop-pile fastening material 46 on the pouch's front side 30.

The holder 80 may be removed from the belt 12 or pouch 28, as applicable, by grasping an end 95 of the panel 82 and pulling the end 95 forwardly across the panel 82.

Another embodiment of a detachable implement holder 96 is shown in FIGS. 7, 8 and 9, and comprises a flexible strip 98 of material such as webbing, joined at a joint 100 near the ends 102 of the strip 98 with one or a first surface 104 of the strip 98 facing the other or a second surface 106 of the strip 98 at the joint 100. The strip 98 is preferably secured to itself, by means such as sewn stitches 107, at the joint 100.

It may be appreciated that the strip 98 forms a loop 108 describing a generally conic surface. Cooperative hook-pile fastening material 110 is secured to the strip 98 at the joint 100 outwardly of the loop 108, i.e. on the first surface 104 of the strip 98 at the rear of or facing away from the loop 108. The hook-pile fastening material preferably extends from the joint 100 outwardly of the loop 108, such as for an additional distance of, say, about one or one and one-half inches, to the ends 102 of the strip 98. In one suitable example of a detachable implement holder 96, a twelve inch length of one and one-half inch wide webbing material was utilized as the strip 98.

Returning again to FIG. 1, the implement holder 96 is shown secured to the lumbar support belt 12. In effecting such securement, the hook-pile fastening material 110 (on the surface 104 of the strip 98 outwardly of the loop 108, at the joint 100 and extending to the ends 102, see FIGS. 7–9) is placed into contact engagement with the loop-pile fastening material 22 on the outer surface 20 of the belt's end section 18. Placement of the implement holder 96 is such that the loop 108 vertically depends from the joint 100 and is outwardly disposed from the belt 12. This type of implement holder 96 is particularly useful for retaining long implements having a head greater than the laterial loop dimension, such as a hammer 112 or a flashlight (not shown) by vertically inserting such implement through the loop 108 for being retained as shown in FIG. 1.

FIG. 1 further illustrates the implement holder 96 removably secured to the pouch 28. The cooperative hook-pile fastening material 110 on the looped strip's first side 104 cooperates with the loop-pile fastening material 46 on the front side 30 of the pouch 28, for releasably fastening the looped strip 98 to the pouch's front side 30. The holder 96 may be removed from the belt 12 or pouch 28, as applicable, by grasping the loop 108 and pulling the loop 108 upwardly.

Figure 10:
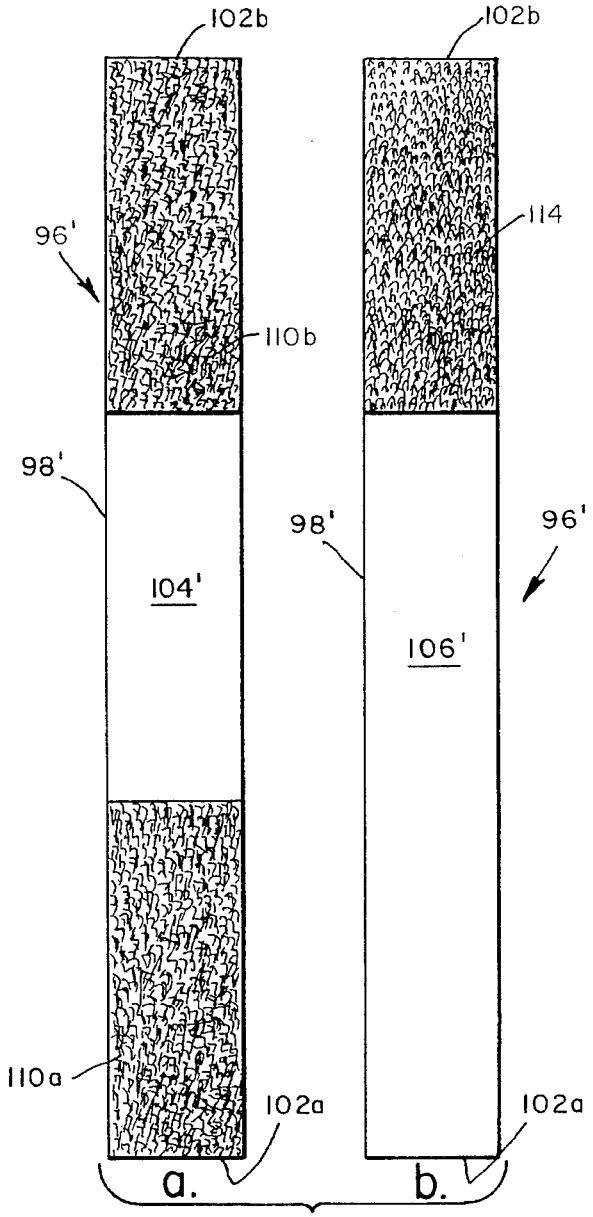
Figure 11:
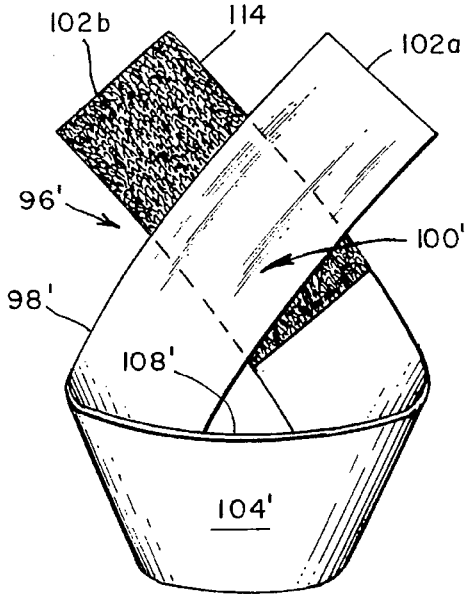
* and FIG. 11 is a perspective front elevation view of the detachable implement holder of FIG. 10 shown in secured configuration.

As shown by the alternative looped implement holder 96' of FIGS. 10 and 11, the size of the loop 108' may be made adjustable by providing means for releasably securing the strip 98' to itself at the joint 100' (indicated in phantom). The one or first surface 104' of the flexible strip of webbing material 98' has secured thereon a pad of a cooperative hook-pile fastener **110*a* extending toward one end 102*a* of the strip 98', as well as another pad of a cooperative hook-pile fastener 110*b* on the first strip surface 104' and extending toward the other end 102*b* of the strip 98'. As shown in FIG. 10*b*, the second or other surface 106' of the strip 98' has secured thereto a pad of a cooperative loop-pile fastener 114 extending toward the second or other end 102*b* of the strip 98'. In one suitable example, the strip 98' was approximately 14 inches long, and each of the hook-pile and loop-pile pads 110*a*, 110*b*, 114 was approximately 4½ inches long; in this example, the width of the strip 98'** (and the pads) was approximately 1½ inches.

The loop 108' is formed by placing a portion of the hook-pile pad **110*a* in contact engagement with a portion of the loop-pile pad 114, such that the pads 110*a*, 114 cooperate with one another for releasably securing the strip 98' to itself at the joint 100' to form the loop 108' depending from the joint 100'. It may be appreciated that the location of the joint 100' along the cooperating pads 110*a*, 114 determines the size of the depending loop 108'**, so that implements of different sizes may be accommodated thereby.

The holder 96' may be removably secured and removed from the lumbar support belt 12 or the pouch 28 in the same manner as the implement holder 96, with the hook-pile fastening material **110*b* at the joint 100' (as well as other exposed portions of the hook-pile pads 110*b*, 110*a*) placed into contact engagement with the loop-pile fastening material of the belt or pouch. It may be appreciated that the holders 80, 96 and 96'** may be removably secured as well to any surface having cooperative loop-pile fastening means thereon, and preferably to such attachment surfaces which are generally vertically oriented.

The weight of the implements retained by the holders 80, 96 or 96', when secured to the worn belt 12 or pouch 28, presents forces between the hook-pile material 88 or 110 and the cooperating loop-pile material 22 or 46 or 114 at angles which would appear to be favorable for promoting fastening strength.

The pouches described may be constructed of any type of material, including cloth, leather or plastic, provided sufficient cooperative loop-pile fastening material 46 is strategically contained on the pouch's front side 30 for accommodating any cooperative hook-pile fastening material contained on the straps 52, or on the implement holders 80, 96, 96'. In this respect, it is advantageous to fabricate the pouch with its entire front side being of cooperative loop-pile fastening material as shown in the drawing.

Thus, there has been described various article holding devices in and for advantageous combination with a lumbar support belt. Other embodiments and modifications of the embodiments shown herein may be developed without departing from the essential characteristics thereof. Accordingly, the invention should be limited only by the scope of the claims listed below.

We claim:

1. Article holding apparatus, comprising in combination:

a lumbar support belt having an inner side and an outer side when worn by a person, said belt including cooperative fastening means on said outer side;

a loop of flexible strip material joined at a joint near the ends of said strip with one surface of said strip facing the other surface of said strip at said joint and said loop depending from said joint; and cooperative fastening means on said strip cooperating with said cooperative fastening means on said outer side of said belt for removably securing said looped strip at said joint to said outer side of said belt.

2. The apparatus according to claim 1, further including:

means securing said strip to itself at said joint.

3. The apparatus according to claim 2, wherein:

said means securing said strip to itself includes cooperative hook-pile fastening means on said one surface of said strip at said joint and cooperative loop-pile fastening means on said other surface of said strip at said joint.

4. The apparatus according to claim 1, wherein:

said cooperative fastening means on said outer side of said belt includes loop-pile fastening means; and said cooperative fastening means on said strip includes hook-pile fastening means on the surface of said strip outwardly of said loop cooperating with said loop-pile fastening means on said outer side of said belt for removably securing said looped strip to said belt.

5. The apparatus according to claim 4, wherein:

said hook-pile fastening means extends from said joint outwardly of said loop.

6. The apparatus according to claim 4, wherein:

said joint includes said rear side including thereon said hook-pile fastening means.

7. The apparatus according to claim 6, wherein:

said hook-pile fastening means extends from said joint outwardly of said loop.

8. A device for use with a lumbar support belt having an inner side and an outer side when worn by a person, comprising the combination of:

a pouch having a front side including thereon cooperative loop-pile fastening means, and a rear side;

two straps each having a first end secured to said rear side of said pouch, each said strap having a free second end, each said strap being of sufficient length between said ends for extending about the inner side of the belt with said straps engaging said front side of said pouch near said second ends when said rear side of said pouch engages the outer side of the belt;

cooperative hook-pile fastening means at said second ends of said straps for cooperating with said cooperative fastening means on said front side of said pouch for releasably securing said second ends to said front side of said pouch;

a loop of flexible strip material secured to itself at a joint near the ends of said strip with one surface of said strip facing the other surface of said strip at said joint; and cooperative hook-pile fastening means on said strip for cooperating with said cooperative loop-pile fastening means on said front side of said pouch for releasably securing said loop at said joint to said pouch.

9. The device according to claim 8, wherein:

said cooperative hook-pile fastening means on said looped strip extends from said joint outwardly of said loop.

10. Article holding apparatus, comprising in combination:

a lumbar support belt having an inner side and an outer side when worn by a person;

a pouch having a rear side for engaging said outer side of said belt;

securing means on said pouch cooperating with said belt for removably securing said pouch to said belt with said rear side of said pouch engaging said outer side of said belt, said securing means including fastening means on said front side of said pouch and two straps, each of said straps having a first end secured to said rear side of said pouch and a second end, said straps extending about said inner side of said belt and cooperating near said second ends with said fastening means on said front side of said pouch for releasably fastening said second ends to said front side of said pouch;

further cooperative fastening means on said front side of said pouch; and implement holding means including a loop of flexible strip material joined at a joint near the ends of said strip with one surface of said strip facing the other surface of said strip at said joint, and cooperative fastening means on said strip cooperating with said further cooperative fastening means on said pouch for removably securing said looped strip at said joint to said pouch.

11. The apparatus according to claim 10, wherein:

said further cooperative fastening means on said front side of said pouch includes cooperative loop-pile fastening means; and said cooperative fastening means on said looped strip includes cooperative hook-pile fastening means on the surface of said strip outwardly of said loop at said joint for cooperating with said cooperative loop-pile fastening means on said front side of said pouch.

12. The apparatus according to claim 11, wherein:

said hook-pile fastening means on said looped strip extends from said joint outwardly of said loop.

13. The apparatus according to claim 11, further including:

means securing said strip to itself at said joint.

14. The apparatus according to claim 13, wherein:

said means securing said strip to itself includes cooperative hook-pile fastening means on said one surface of said strip at said joint and cooperative loop-pile fastening means on said other surface of said strip at said joint.

* * * * *